US005317983A

United States Patent [19]

Strifors et al.

[11] Patent Number: 5,317,983

[45] Date of Patent: Jun. 7, 1994

[54] SHALLOW-DRAFT WATERCRAFT

[75] Inventors: Hans C. Strifors, Täby; Rolf Söderqvist, Järfälla, both of Sweden

[73] Assignee: Trelleborg Industri AB, Trelleborg, Sweden

[21] Appl. No.: 959,768

[22] Filed: Oct. 13, 1992

[51] Int. Cl.[5] ..... B63B 7/08

[52] U.S. Cl. ..... 114/61; 114/345; 114/357

[58] Field of Search ..... 114/61, 123, 344, 345, 114/357; 441/40, 41, 66, 129

[56] References Cited

U.S. PATENT DOCUMENTS

| | | | |
|---|---|---|---|
| 824,506 | 12/1859 | Morton . | |
| 2,743,510 | 5/1956 | Mauney et al. | 114/345 |
| 3,001,213 | 4/1957 | Stark et al. | 9/11 |
| 3,473,502 | 6/1968 | Wittkamp | 114/39 |
| 4,462,331 | 7/1984 | McCrory | 114/345 |
| 4,660,497 | 4/1987 | Cochran | 114/345 |
| 4,928,619 | 5/1990 | Cochran | 114/345 |

FOREIGN PATENT DOCUMENTS

| | | |
|---|---|---|
| 924675 | 3/1955 | Fed. Rep. of Germany . |
| 3304702 | 8/1984 | Fed. Rep. of Germany . |

*Primary Examiner*—David M. Mitchell
*Assistant Examiner*—Stephen P. Avila
*Attorney, Agent, or Firm*—Nils H. Ljungman & Associates

[57] ABSTRACT

The invention relates to a shallow-draft watercraft having the ability to withstand impact stresses caused by upwardly travelling water movement corresponding to a shock factor (CF) of up to about 1.5. The watercraft comprises at least one superstructure, which is intended to be located above the surface of the water, at least two pontoons which float on the water, and devices for supporting the superstructure. The watercraft is characterized in that the pontoons are gas-tight and gas-filled and of a substantially cylindrical and elongated configuration. The pontoon walls include several layers of material, of which at least one layer inwardly of the outermost layer is a reinforcing layer. The reinforcing layer includes threads which are wound in at least three directions, wherein the material layers are disposed so that the pontoons are rigid with regard to bending, transversely acting forces and axial rotation, provided that an overpressure prevails within the gas-filled pontoons. The superstructure supporting devices rest on the pontoons, essentially transversely to the longitudinal axis of the pontoons.

20 Claims, 2 Drawing Sheets

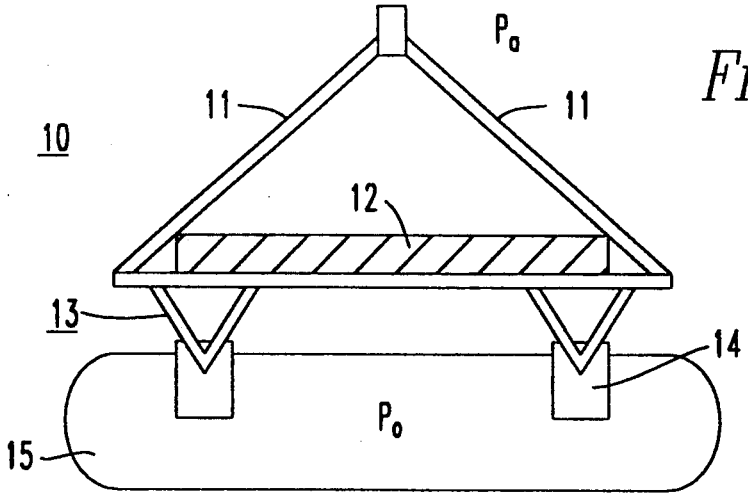
Fig. 1
Fig. 3
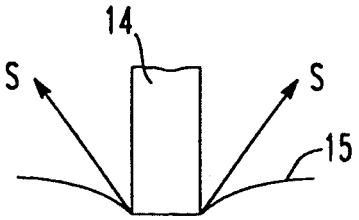
Fig. 2
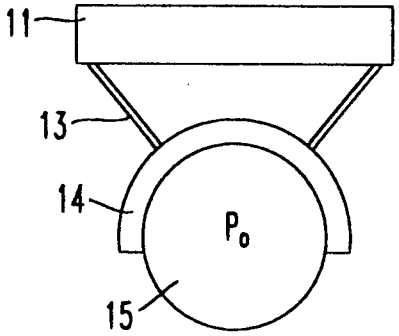
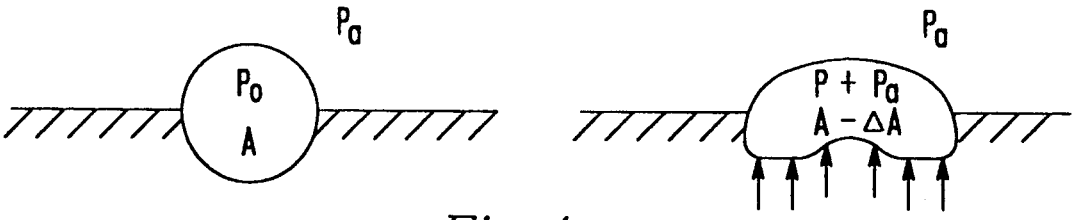
Fig. 4
Fig. 5
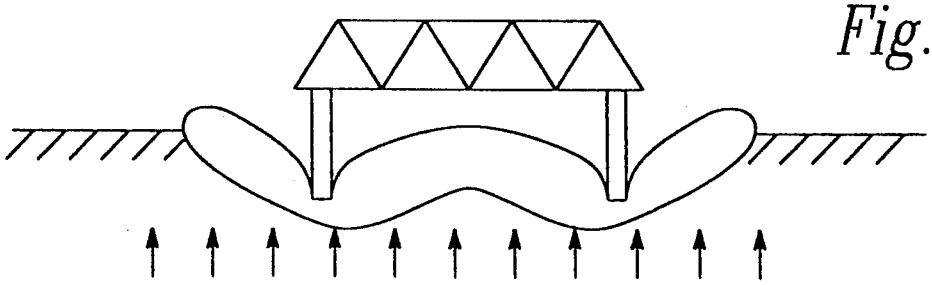

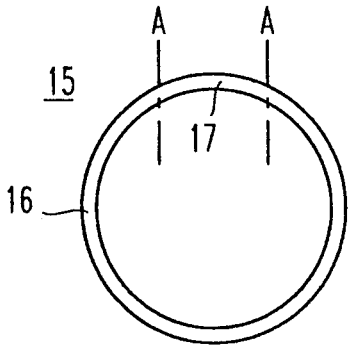
Fig.6
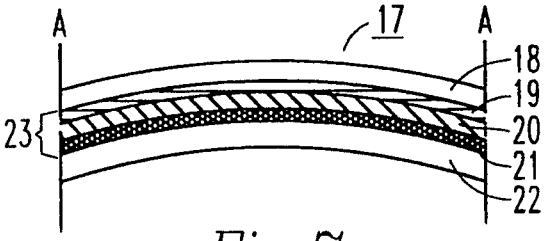
Fig.7
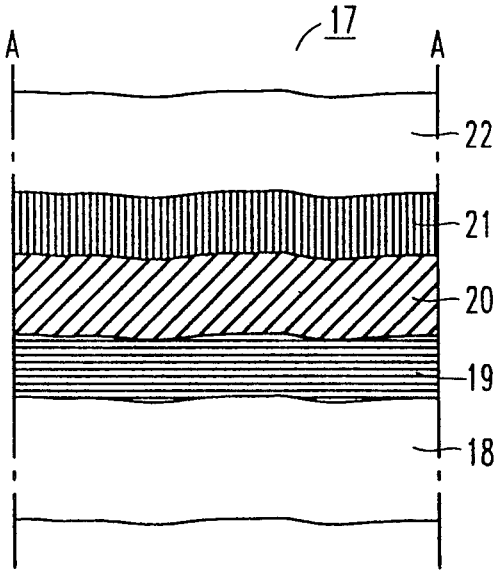
Fig.8
Fig.9
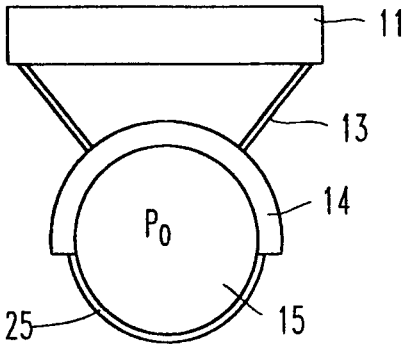

SHALLOW-DRAFT WATERCRAFT

The invention relates to a shallow-draft watercraft which is capable of resisting impact stresses created by upwardly-travelling water masses corresponding to a shock factor (CF) of up to about 1.5. The watercraft includes at least one superstructure which is intended to lie above the surface of the water, and at least two, water-buoyant pontoons which float in the water, and means for supporting the superstructure.

The watercraft is particularly useful for mine-removal work and as a depth charge trap, but can also be used beneficially for research and other purposes involving the user of underwater detonations, for instance in the underwater construction of industrial plants and tunnels.

Shallow-draft watercraft comprising pontoons and a superstructure are previously known and one such vessel in the form of a sailing catamaran is described and illustrated in U.S. Pat. No. 3,473,502. This vessel is constructed as a lightweight boat which can be dismantled quickly and easily for transportation and storage. The pontoons are constructed from thin-gauge material capable of withstanding a given desired pontoon gas pressure, and may comprise rubber, vinyl plastic and similar polymeric material. It will be obvious that such vessels are not suitable for the extremely difficult areas of use indicated in the introduction.

The shock factor CF is a measurement of stresses resulting from an underwater detonation. The factor CF is calculated from the charge weight W expressed in kg for an equivalent TNT-charge and the distance r expressed in m in accordance with the relationship $$CF=(W)^{0.5}.r^{-1}$$

The shock factor CF is a measurement of the energy per unit area of the upwardly travelling shock wave caused by the detonation and is a good indication of the damage effect on objects present beneath the surface of the water. Lightweight, shallow-draft water vessels are greatly influenced by motion or movement of the surface of the water. This movement, or motion, is composed of two effects, gravitational heaving, where the shock wave is reflected against the water surface, and surface heaving caused by expansion of the gas globe created by the detonation. These two magnitudes of fares are directly proportional to the square of the shock factor.

A watercraft that is constructed to resist a high shock factor when sweeping pressure mines is described in U.S. Pat. No. 3,340,843. The construction is a lattice-work structure of mutually connected tubular parts whose hollow interiors are filled with a liquid with the intention of enhancing shock resistance. A series of buoyant cells are arranged in the upper parts of the lattice-work structure. Each of these buoyant cells is comprised of an inner rubber container, an intermediate protective layer of elastic, porous fabric, and outer casings in the form of steel-wire nets, these nets being welded firmly to the upper horizontal parts of the lattice-work structure. The bottom of the vessel is covered with panels made of a rigid, flexible and resilient material, the intention being that these panels shall resist the shock waves through the inherent resiliency of the panels. In other words, the construction is based mainly on the rigidity, although also on the resiliency of the actual bottom panels themselves, said panels being mounted in direct contact with the rigid lattice structure.

It will be obvious to one of normal skill in this art that a vessel of this nature will not withstand an unlimited number of powerful shock waves of magnitudes in the other of CF=1-1.5, despite its sophisticated design, and that the lattice structure will be subjected to damage and—even worse—the instrumentation and devices necessary for mine-removing operations or the like and forming an important part of the vessel payload will also be subjected to damage.

The object of the present invention is to provide a watercraft which is able to resist impact stresses caused by upwardly travelling water movement corresponding to a shock factor CF of up to about 1.5, while shielding the vessel payload, in the form of instruments and other devices and possibly also its crew, from serious disturbance or damage as a result of such powerful stresses caused by water motion.

The invention is characterized to this end by the features set forth in the following claims.

The watercraft is thus equipped with gas-filled and gas-tight pontoons. The pontoons are generally cylindrical and elongated and the pontoon walls are comprised of a plurality of layers of material, of which at least one layer disposed inwardly of the outer layer is a reinforced layer. This reinforcing layer comprises fibres or threads which are wound in at least three directions. The reinforcement is tensioned by filling the pontoon with gas to a predetermined overpressure, the gas used preferably being compressed air. The material layers of the pontoon wall are preferably disposed so that the pontoons will be rigid with respect to bending, transverse forces and axial rotation (twisting), provided that an overpressure prevails within the gas-filled pontoons. The devices which support the vessel superstructure rest on the pontoons, generally transversely to the longitudinal axis thereof.

Preferably, at least one of the layers of the pontoon walls is comprised of a polymeric material, for instance synthetic rubber. In this case, the layer can be chosen to render the pontoon impervious to gas. However, it is also possible to achieve gas-imperviousness, and therewith the desired pretensioning, with the aid of separate rubber bladders which are brought into abutment with a reinforcing wall which, in itself, is not impervious to gas.

The reinforcing layer preferably includes a yarn of roving (fibre cable) having a high modulus of elasticity and also being creep-free. The reinforcing layer is preferably constructed from aramide fibres.

Aramide fibre yarn is strong, rigid and light in weight and will not stretch when subjected to load over long periods of time. Aramide fibres are today used as a general rubber reinforcement, when extra strong and flexible constructions are required.

The vessel superstructure is supported by devices which are usually provided with a saddle-shaped part which rests on the pontoons and partially surrounds the same. In this regard, it is important that neither the superstructure nor the superstructure-supporting devices will abut the pontoons in a manner which prevents the same from bending in the transverse direction. Thus, there shall be no longitudinally extending beams or other parts which lie against the pontoons or are located close to the upper surfaces thereof. The pontoons are best secured to the supporting devices by bands, straps or the like arranged around the underside of the pontoons. This reduces the risk of the superstructure being jolted from the pontoons in heavy swells or as a result of similar powerful motion caused by an underwater detonation.

The invention will now be described in more detail with reference to the accompanying drawing, in which FIG. 1 is a schematic illustration of the shallow-draft watercraft as seen from one side;

FIG. 2 illustrates forces acting on the pontoons;

FIG. 3 is a longitudinal view of pontoon supporting devices;

FIG. 4 illustrates horizontal depression or indentation of the pontoons;

FIG. 5 illustrates schematically the behaviour of the watercraft when subjected to powerful upwardly travelling water movements;

FIG. 6 is a side view of pontoon 15;

FIG. 7 is a view of a cross-sectional view of pontoon 15 taken through lines A—A of FIG. 6;

FIG. 8 is an overhead cross-sectional view of pontoon 15;

FIG. 9 is substantially the same as FIG. 3, but additionally depicting a band.

FIG. 1 illustrates a watercraft 10 constructed in accordance with a preferred embodiment of the invention. The watercraft 10 comprises a superstructure 11 in the form of a simple lattice structure and a load 12 present in the superstructure 11. The superstructure 11 rests on and is supported by devices 13 that rest on one pontoon 15, of which devices only two are shown in the Figure. The lower part of respective devices 13 is saddle-shaped 14 and partially surrounds the pontoon 15 on which the devices support. The pontoons 15 are impact absorbing elements which are rigid under normal loads but which yield resiliently to overload pressure. The internal pressure $P_o$ of the pontoons 15 is greater than atmospheric pressure $P_a$, so that pressure P equals $P_o - P_a$, where $P_a$ is atmospheric pressure, and pretensions the reinforcement in the walls on the pontoon 15.

The superstructure 11 is supported by a membrane tension 5 which, as shown, acts along the edge of the saddle 14 and produces a highest supporting force $$F_{max} = 2DS$$

where D is the diameter of the pontoon 15. The tension S for a pontoon which is not subjected to bending stresses is $$S = PD/4$$

and hence the supporting force is at most $$F_{max} = \tfrac{1}{2}PD^2$$

for a narrow saddle 14, whereas for a saddle having width B the force equals PDB.

FIG. 3 is an illustration in the cross-direction of the watercraft which shows the lower part of the superstructure 11 supported by the supporting device 13 whose lower part 14 is semi-circular in shape and partially embraces the pontoon 15.

When the pontoon 15 is subjected to bending loads caused by acceleration of the mass in response to upwardly directed water movement, the tension S will decrease and the pontoon 15 will ultimately yield around a line on its underside and the reinforcement on the upper side will buckle so that the tension S will be equal to 0. The tension acting on the width of the saddle 14, i.e. the ring tension, is not effected by the bending load.

When the pontoon 15 is secured to the saddle 14 by means of a band (not shown) extending around the underside of the pontoon, the same phenomenon occurs in the case of a downwardly acting force resulting from inertia forces from the co-oscillating water mass. The downwardly acting force, which is the same order of magnitude as the displacement, holds back the pontoon 15. When a shock wave strikes the pontoon, the underwater part of the pontoon is pressed in, causing the internal pressure P to rise rapidly.

Occurrent accelerations are controlled by the maximum bearing strength, which is also utilized during the first part of a blasting sequence when the shock wave is reflected against the free surface of the water and gives rise to cavitation. The shock wave also strikes the underwater part of the pontoon and presses in said part so as to reduce the volume thereof. This depression of the pontoon is illustrated in FIG. 4, which illustrates pressure and area in a rest state and when subjected to the effect of a shock wave respectively, as indicated by the upwardly directed arrows. Bending of the pontoon around the support legs as a result of this compression and the forces of the shock wave is illustrated schematically in FIG. 5.

Depression of the pontoon reduces the enclosed area $\lambda$ by the sum $\Delta\lambda$ and is closely related to heaving resulting from reflection of the blasting wave against the water surface and is therefore proportional to $(CF)^2$ and inversely proportional to the inner pontoon pressure. In turn, depression of the pontoon results in a relative reduction in volume which increases the total pressure at rest P. The enclosed air mass oscillates at a frequency which corresponds to one wavelength of twice the pontoon length, about 15 Hz. It is the overpressure P which gives the membrane tension $$P + P_a = P_o(l = \Delta\lambda/\lambda)^{-1.4}$$

since depression of the pontoon takes place at adiabatically. Depression in the semi-submerged pontoon is estimated to be $$d = \Delta\lambda/D = \text{const. } CF^2/P_o.$$

The supporting capacity of a saddle is $PD^2/2$, since the pontoon wall is relieved of load by the prevailing atmospheric pressure $P_a$. The pontoon is now subjected to a weight which presses the pontoon down into the water to an extent equal to half the diameter of the pontoon. Occurring acceleration a $m/s^2$ can than at most be (supporting capacity)/(weight) for each saddle. The weight is $$\rho\pi D^2 l/8$$

where l m is the pontoon length loaded by a saddle and D is the density of the water. A series expansion of the expression for $P + P_a$ gives the following acceleration value $$a_{max} = 0.0013(P + \text{const.}(CF)^2)/l.$$

P can be ignored in the case of high shock loads and the expression is written as $$a_{max} = \text{const.}(CF)^2/l.$$

It can be calculated from these expressions that an inventive watercraft will suitably have a length l of about 15 m, a width of about 7 m and capable of supporting a mass m of about 2,500 kg on each support leg.

EXAMPLE

An inventive watercraft constructed on an experimental scale and having a length of 3 m, a width of 2 m and a pontoon diameter of 0.6 m and a total weight of 800 kg was subjected to the effect of shock waves emanating from the underwater detonation of a series of explosive charges.

During these experiments, recordings were made of the acceleration in the superstructure, the internal pontoon pressure and the forces occurring in two support legs. The sequence of happenings was filmed with high-speed cameras and also with video cameras.

The shock pressures achieved in the experiments corresponded to CF 1.5–2 for a full-size watercraft, i.e. around and above the contemplated specifications for an inventive watercraft.

The experiments showed that when the mean value of the first 50 ms is used, the acceleration signal, force signal, pontoon pressure signal and high speed film give approximately the same values for the occurrent acceleration at these levels of the shock factor CF.

Turning now to the remainder of the drawings, FIG. 6 shows a pontoon 15 having an outer wall 16. As described more fully below, outer wall 16 comprises several material layers. A section of wall 17, taken between the lines A—A, is shown in greater detail in FIG. 7.

As shown in wall section 17 in FIG. 7, the wall, in a preferred embodiment of the present invention, preferably consists of five different material layers, as follows: an outer rubber layer 18, a first thread layer 19, a second thread layer 20, a third thread layer 21 and an inner rubber layer 22. Together, the three thread layers 19–21 make up a reinforcement layer 23. As shown, the layers are all preferably nested and disposed adjacent one another, preferably in the sequence listed above.

It should be understood that the outer layer 18 and inner layer 22 each need not necessarily be made of rubber; other suitable materials, such as neoprene or other types of synthetic material, may be used in outer layer 18 and inner layer 22. Also, as has been described heretofore, the material used for the threads in layers 19–21 is preferably a yarn or roving which has a high modulus of elasticity and which essentially exhibits a highly reduced tendency towards creeping and preferably exhibits freedom from creeping. Such a material may be, for example, an aramide fibre.

As shown, the threads in each layer 19–21 of reinforcement layer 23 are preferably wound in three different directions, or orientations. That is, the threads in a given layer 19–21 of reinforcement layer 23 are preferably wound so as to lie in an orientation different from the orientation of the threads in each of the other thread layers.

FIG. 8 illustrates the winding of threads in each of the thread layers 19–21. Particularly, in FIG. 8, wall section 17 is shown in an overhead view and, in a cutaway manner, a view of a portion of each of the layers 18–22, including thread layers 19–21, is afforded. Thus, as shown, in a preferred embodiment of the present invention, the threads of layer 19 may be ring-wound, those of layer 20 may be cross-wound and those of layer 21 may be longitudinally wound. Particularly, as shown, the ring-wound threads of layer 19 may be wound such that they extend in a direction corresponding to the circular circumference of pontoon 15 and are thus wound around the circular cross-section of pontoon 15 shown in FIG. 6. Accordingly, the longitudinally wound threads of layer 21 preferably extend longitudinally along pontoon 15 and are thus preferably oriented transversely with respect to the threads of layer 19. Additionally, the cross-wound threads of layer 20 may be oriented diagonally with respect both to the threads of layer 19 and to those of layer 21.

It should be understood that the threads in each of the thread layers 19–21 may be arranged in a manner different from orientations shown in FIG. 8, as long as there are essentially three different orientations, or directions of windings provided, one corresponding to each layer 19–21.

FIG. 9 is substantially similar to FIG. 3, but shows a band 95 for securing pontoon 15 to saddle 14. Preferably, either and of band 25 is appropriately attached to saddle 14 and extends about a portion of the circumference of pontoon 15 between ends of saddle 14. Band 25 may be in the form of a band, strap, or other appropriate arrangement for securing pontoon 15 to saddle 14. Preferably, band 25 is configured to take up forces acting downwardly from pontoon 15 to saddle 14. In other words, band 25 is essentially configured to transfer downward forces of the pontoon 15 to saddle 14.

All, or substantially all, of the components and methods of the various embodiments may be used in any combination with at least one embodiment or all of the embodiments, if any, described herein.

All of the patents, patent applications and publications recited herein, if any, are thereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings in their entirety, including all dimensions, proportions and/or shapes in at least one embodiment of the invention, are, if applicable, accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

We claim:

1. A shallow-draft watercraft comprising:

said watercraft being configured for withstanding impact stresses caused by shock;

at least one superstructure which is configured for being located above the surface of the water;

at least two pontoons for floating in the water, each of the pontoons defining a longitudinal axis;

superstructure-supporting devices for supporting the superstructure said pontoons being gas-tight and gas-filled;

each of said pontoons being of an essentially cylindrical and elongated configuration;

each of said pontoons comprising at least one wall and an external surface defined by said at least one wall;

each said at least one wall of each of said pontoons comprising a plurality of material layers;

said plurality of material layers comprising an outermost layer and at least one layer disposed inwardly of said outermost layer, at least one of said at least one layer disposed inwardly of said outermost layer being a reinforcing layer;

said reinforcing layer comprising at least a first series of threads, a second series of threads and a third series of threads;

said at least one wall of each of said pontoons defining at least a first dimension, a second dimension and a third dimension with respect to said external surface of each of said pontoons;

said first series of threads being generally aligned along said first dimension;

said second series of threads being generally aligned along said second dimension;

said third series of threads being generally aligned along said third dimension;

at least a portion of said first series of threads extending about at least a substantial portion of the corresponding pontoon along said first dimension;

at least a portion of said second series of threads extending about an least a substantial portion of the corresponding pontoon along said second dimension;

at least a portion of said third series of threads extending about at least a substantial portion of the corresponding pontoon along said third dimension;

said first series of threads defining a substantial angle with respect to each of said second series of threads and said third series of threads;

said second series of threads defining a substantial angle with respect to each of said first series of threads and said third series of threads;

said third series of threads defining a substantial angle with respect to each of said first series of threads and said second series of threads;

said material layers being disposed so that said pontoons are rigid with regard to bending, transversal forces and axial rotation when an overpressure prevails within said pontoons; and said superstructure-supporting devices being configured to rest on said pontoons, generally transversely to the longitudinal axis of each of said pontoons.

2. The watercraft according to claim 1, wherein said first series of threads, said second series of threads and said third series of threads are configured for withstanding impact stresses caused by outwardly travelling water movements corresponding to a shock factor of about 1.5.

3. The watercraft according to claim 2, wherein said first series of threads is oriented substantially orthogonally with respect to said second series of threads.

4. The watercraft according to claim 3, wherein said third series of threads defines a substantial acute angle with respect to each of said first series of threads and said second series of threads.

5. The watercraft according to claim 4, wherein said external surface of each of said pontoons defines a longitudinal dimension and a circumferential dimension;

the longitudinal dimension is said first dimension and is defined parallel to the longitudinal axis;

the circumference dimension is said second dimension and is defined about a circumference of each of said pontoons and being generally orthogonal with respect to the longitudinal dimension;

said first series of threads is aligned along the longitudinal dimension of the corresponding pontoon;

said second series of threads is aligned along the circumferential dimension of the corresponding pontoon; and said third series of threads is oriented generally diagonally with respect to said first and second series of threads.

6. The watercraft according to claim 5, wherein said first series of threads, said second series of threads and said third series of threads each comprises a separate layer of threads, such that said first series of threads, said second series of threads and said third series of threads are all layered with respect to one another.

7. The watercraft according to claim 6, wherein:

said first series of threads are wound at least once about the entire circumferential dimension of the corresponding pontoon;

said second series of threads are wound about substantially the entire longitudinal dimension of the corresponding pontoon; and said third series of threads are wound diagonally with respect to said first and second series of thread and throughout substantially the entire longitudinal extent of the corresponding pontoon.

8. A watercraft according to claim 7, wherein at least one of said material layers comprises a polymeric material.

9. A watercraft according to claim 8, wherein the reinforcing layer includes one of yarn and roving, said one of yarn and roving having a high modulus of elasticity and being configured to exhibit freedom from creeping.

10. A watercraft according to claim 9, wherein said superstructure-supporting devices includes a saddle-shaped part which rests against the pontoons and partially embraces said pontoons.

11. A watercraft according to claim 10, further comprising one of bands and straps, said one of bands and straps being configured for securing said supporting devices to said pontoons and for taking up forces which act downwardly from the pontoons to the saddle-shaped part.

12. The watercraft according to claim 11, wherein said polymeric material comprises rubber.

13. The watercraft according to claim 12, wherein said one of yarn and roving comprises aramide fibre.

14. A watercraft according to claim 7, wherein said reinforcing layer includes one of yarn and roving, said one of yarn and roving having a high modulus of elasticity and being configured to exhibit freedom from creeping.

15. A watercraft according to claim 14, wherein said superstructure-supporting devices includes a saddle-shaped part which rests against said pontoons and partially embraces said pontoons.

16. A watercraft according to claim 15, further comprising one of bands and straps, said one of bands and straps being configured for securing said supporting devices to said pontoons and for taking up forces which act downwardly from said pontoons to said saddle-shaped part.

17. The watercraft according to claim 16, wherein said one of yarn and roving comprises aramide fibre.

18. A watercraft according to claim 7, wherein said superstructure-supporting devices includes a saddle-shaped part which rests against said pontoons and partially embraces said pontoons.

19. A watercraft according to claim 18, further comprising one of bands and straps, said one of bands and straps being configured for securing said supporting devices to said pontoons and for taking up forces which act downwardly from said pontoons to said saddle-shaped part.

20. A watercraft according to claim 8, wherein:

said superstructure-supporting devices includes a saddle-shaped part which rests against said pontoons and partially embraces said pontoons;

said watercraft comprises one of bands and straps, said one of bands and straps being configured for securing said supporting devices to said pontoons and for taking up forces which act downwardly from said pontoons to said saddle-shaped part; and said polymeric material comprises rubber.

* * * * *

UNITED STATES PATENT AND TRADEMARK OFFICE

CERTIFICATE OF CORRECTION

PATENT NO. : 5,317,983

DATED : June 7, 1994

INVENTOR(S) : Hans CHRISTER STRIFORS and Rolf SODERQVIST

It is certified that error appears in the above-indentified patent and that said Letters Patent is hereby corrected as shown below:

In column 1, line 15, after 'the' delete "user" and insert --use--.

In column 4, line 29, delete "$\lambda$" and insert --A--.

In column 4, line 29, after 'sum' delete "$\Delta\lambda$" and insert --$\Delta$A--.

In column 4, line 35, after 'rest' delete "P" and insert --$P_o$--.

In column 4, line 46, in the equation, delete "$\Delta\lambda/D$" and insert --$\Delta$ A/D--.

In column 6, line 19, after 'band' delete "95" and insert --25--.

UNITED STATES PATENT AND TRADEMARK OFFICE

CERTIFICATE OF CORRECTION

PATENT NO. : 5,317,983

DATED : June 7, 1994

INVENTOR(S) : Hans CHRISTER STRIFORS and ROLF SODERQVIST

It is certified that error appears in the above-indentified patent and that said Letters Patent is hereby corrected as shown below:

In column 7, line 23, Claim 1, after 'about' delete "an" and insert --at--.

In column 7, line 65, Claim 5, after 'the' delete "circumference" and insert --circumferential--.

In column 8, line 35, Claim 10, after 'devices' delete "includes" and insert --include--.

In column 8, line 66, Claim 18, after 'devices' delete "includes" and insert --include--.

In column 10, line 1, Claim 20, after 'devices' delete "includes" and insert --include--.

Signed and Sealed this

First Day of October, 1996

Bruce Lehman

*Attest:*

BRUCE LEHMAN

*Attesting Officer*

*Commissioner of Patents and Trademarks*